United States Patent [19]

Reuter et al.

[11] Patent Number: 4,524,010

[45] Date of Patent: Jun. 18, 1985

[54] HIGH-SUDSING, GRANULAR DETERGENT COMPOSITION WITH GREATER GRANULATE STABILITY AND PROCESS FOR ITS PREPARATION

[75] Inventors: Herbert Reuter, Hilden; Wolfgang Seiter, Neuss; Ingo Wegener, Dusseldorf, all of Fed. Rep. of Germany

[73] Assignee: Henkel Kommanditgesellschaft (KGaA), Dusseldorf, Fed. Rep. of Germany

[21] Appl. No.: 442,094

[22] Filed: Nov. 16, 1982

[30] Foreign Application Priority Data

Dec. 28, 1981 [DE] Fed. Rep. of Germany ..... 3151536

[51] Int. Cl.[3] ..... C11D 1/12

[52] U.S. Cl. ..... 252/135; 252/174.25; 252/534; 252/553

[58] Field of Search ..... 252/135, 140, 174.25, 252/531, 539, 550, 558, 534, 553

[56] References Cited

U.S. PATENT DOCUMENTS

| | | | |
|---|---|---|---|
| 3,844,969 | 10/1974 | Griffiths et al. | 252/558 |
| 3,985,669 | 10/1976 | Krummel et al. | 252/174.25 |
| 4,072,621 | 2/1978 | Rose | 252/89 R |
| 4,169,075 | 9/1979 | Kuhling et al. | 252/588 |
| 4,180,485 | 12/1979 | Llenado | 252/174.25 |
| 4,243,544 | 1/1981 | Taylor | 252/174.25 |
| 4,249,903 | 2/1981 | Smolka et al. | 252/140 |
| 4,269,722 | 5/1981 | Joshi et al. | 252/90 |
| 4,344,871 | 8/1982 | Allaway et al. | 252/135 |
| 4,350,619 | 9/1982 | Nakamura et al. | 252/174.25 |
| 4,351,740 | 9/1982 | Joshi et al. | 252/90 |

FOREIGN PATENT DOCUMENTS

| | | |
|---|---|---|
| 2536594 | 3/1976 | Fed. Rep. of Germany . |
| 2704310 | 8/1977 | Fed. Rep. of Germany . |
| 2615698 | 10/1977 | Fed. Rep. of Germany . |
| 79905 | 7/1978 | Japan . |

*Primary Examiner*—Paul Lieberman
*Assistant Examiner*—Hoa Van Le
*Attorney, Agent, or Firm*—Ernest G. Szoke; Nelson Littell, Jr.

[57] ABSTRACT

A spray-dried, high-sudsing detergent granulate is disclosed having a bulk density of not more than 450 gm/l and a high content of anionic tensides, which is characterized by a granule structure resistant to mechanical and climatic influences. The detergent granulate contains a tenside component of alkylbenzene sulfonates and, possibly, fatty alcohol sulfates, a builder component of sodium tripolyphosphate, finely crystalline sodium aluminosilicate (zeolite NaA) and sodium silicate. For the preparation, an aqueous slurry is sprayed in spray-drying equipment. The obtained spray-dried product has a porous granule structure with a mean granule size of 0.4 to 0.8 mm. The bulk density is preferably in the range from 250 to 400 gm/l.

4 Claims, No Drawings

HIGH-SUDSING, GRANULAR DETERGENT COMPOSITION WITH GREATER GRANULATE STABILITY AND PROCESS FOR ITS PREPARATION

BACKGROUND OF THE INVENTION

The present invention concerns a detergent composition with a high content of anionic tensides that is characterized by a granule structure resistant to mechanical or unfavorable climatic influences and is especially suitable for washing textiles and other solid surfaces by hand. Such agents lend themselves particularly well for use in developing countries, where laundering is done under still relatively simple conditions, such as in the tub and without additional heating.

Detergent compositions used in such cases must meet a number of special requirements. Since, in the route from the producer to the consumer, these detergent compositions are not infrequently repackaged several times and are usually transported via long and often imperfect shipping routes, the mechanical resistance of the granulate must meet more stringent requirements. The mechanical resistance and free-flowing quality must be retained even under unfavorable climatic conditions, especially in areas of high relative humidity of the air. The detergent compositions should be suitable not only as single detergents but also combinable and compatible with additives conventionally used and easily available in the respective consumer country, for example, such as soap powder, bleach and similar substances, and the granule structure must largely remain intact also during a mixing process carried out under less than optimal conditions, and it must be formulated to prevent separations during further transporting of the products. On the other hand, the granules should break up quickly when added to cold water and dissolve after brief stirring, despite their mechanical resistant quality.

An inadequately informed consumer, possibly an illiterate, usually judges the action of a detergent by the foam developed and regulates the amount to be used accordingly, which is the reason for the preferability of high-sudsing substances to prevent the use of excessive amounts and the environmental damage resulting from it. Consequently, nonionic tensides are less suitable for this purpose of washing by hand because of their low foaming tendency, especially since they have the characteristic of removing the oils from the skin to a particularly efficient degree and leave an unpleasant feeling on the skin.

Detergent compositions consisting of compact granules and surfactants incorporated in them are known, for example, for German published Application DE-OS No. 25 36 594 and U.S. Pat. No. 4,269,722. These are socalled carrier granules that are produced by spray-drying or shaping without an addition of detergent and then charged with liquid or molten nonionic tensides. The process requires several procedural steps and is relatively expensive. Such a process is not suitable for the saltlike anionic tensides. Such prior art powders also have a very compact granule structure and a comparable high bulk density exceeding 500 gm/l, usually 600 to 800 gm/l. However, such dense detergent granules with a high specific weight dissolve only very slowly in cold or moderately warm water. Since they, in contrast to less dense spray-dried powders, sink immediately to the bottom in the wash water, a sediment forms in the wash tub when they are used and this dissolves completely only after prolonged stirring. In such cases, it is also very difficult to judge at what point the dissolving process is completed.

The preparation of granular detergents by spray-drying is also known, but the spray-drying of conventional formulations generally produces relatively soft, loose powders with spherical structure. Their bulk density lies generally definitely below 500 gm/l and is usually 200 to 350 gm/l. This type of powder, which is normally produced by spraying an aqueous detergent slurry under high pressure through stationary jets, does have optimal dissolving characteristics, but its resistance to mechanical stress is relatively low. Older drying equipment with rotating spray jets do produce a more compact but very much smaller granule with a high proportion of dust. Such powders have a strong tendency to clump together and have unfavorable pouring characteristics. Also problematical is the spray-drying of detergents with a high content of organic substance, i.e., exceeding 40%, at the usually high drying temperatures in the spray-drying towers because of the danger of dust explosions and autoxidation processes that can result in the browning of the powder.

OBJECTS OF THE INVENTION

An object of the present invention is the development of a spray-dried, high-sudsing detergent granulate having a bulk density of not more than 450 gm/l and a high content of anionic tensides, which is characterized by a granule structure resistant to mechanical and climatic influences.

Another object of the present invention is the development of a high-sudsing, granular, spray-dried detergent composition with excellent granule stability comprised of anionic surface-active compounds, sodium tripolyphosphate, sodium aluminosilicate and sodium silicate, having a bulk density of not more than 450 gm per liter and the composition of:

(A) from 35% to 50% by weight of a sodium linear alkylbenzene sulfonate having from 10 to 14 carbon atoms in the alkyl, (B) from 0 to 15% by weight of a sodium fatty alcohol sulfate where said fatty alcohol has from 10 to 20 carbn atoms and is selected from the group consisting of alkanols and alkenols, where the sum of the components (A) and (B) is from 35% to 50% by weight, (C) from 5% to 25% by weight of sodium tripolyphosphate, from 5% to 25% by weight of finely crystalline sodium aluminosilicate having the formula:

$$0.7\text{–}1.5\ Na_2O.Al_2O_3.\ 1.3\text{–}4\ SiO_2$$

and having a calcium binding power of at least 100 mg CaO/gm of active substance (AS) and a particle size of less than 25 $\mu$, with at least 80% by weight of the particles having a size of less than 10 $\mu$, (E) from 5% to 25% by weight of sodium silicate of the composition:

$$Na_2O:\ SiO_2 = 1:1.5 \text{ to } 1:3.6,$$

(F) from 0 to 10% by weight of sodium sulfate and/or sodium carbonate, and (G) from 8% to 15% of water, including bound water and water of crystallization contained in components (C) to (F), where the sum of the components (C) to (G) is from 50% to 65% by weight.

These and other objects of the invention will become more apparent as the description thereof proceeds.

DESCRIPTION OF THE INVENTION

The above objects have been achieved and the above-mentioned disadvantages are avoided with the present invention.

The present invention relates to a high-sudsing, granular, spray-dried detergent composition with a greater granule stability, which contains anionic tensides, sodium tripolyphosphate, sodium aluminosilicate and sodium silicate, characterized by a bulk density of not more than 450 gm/l as wel as a content of:

(A) from 35% to 50% by weight of sodium linear-alkylbenzene sulfonate with 10 to 14 carbon atoms in the alkyl chain, (B) 0 to 15% by weight of sodium fatty alcohol sulfate with 10 to 20 carbon atoms in the alkyl or alkenyl radical, where the sum of components (A) and (B) amounts to 35% to 50% by weight.

(C) 5% to 25% by weight of sodium tripolyphosphate, (D) 5% to 25% by weight of finely crystalline sodium aluminosilicate of the formula:

$$0.7\text{–}1.5\ Na_2O.Al_2O_3.1.3\text{–}4\ SiO_2 \quad (I)$$

which contains bound water, has a calcium-binding capacity of at least 100 mg CaO/gm active substance (AS) and a particle size of less than 25 $\mu$, with at least 80% by weight of the particles having a size of less than 10 $\mu$, (E) 5% by weight of sodium silicate of the composition:

$$Na_2O:SiO_2 = 1:1.5 \text{ to } 1:3.6,$$

(F) 0 to 10% by weight of sodium sulfate and/or sodium carbonate, and (G) 8% to 15% by weight of water including the bound water and water of crystallization in the components (C) to (F), where the sum of the components (C) to (G) amounts to 50% to 65% by weight.

More particularly, the present invention relates to a high-sudsing, granular, spray-dried detergent composition with excellent granule stability comprised of anionic surface-active compounds, sodium tripolyphosphate, sodium aluminosilicate and sodium silicate, having a bulk density of not more than 450 gm per liter and the composition of:

(A) from 35% to 50% by weight of a sodium linear alkylbenzene sulfonate having from 10 to 14 carbon atoms in the alkyl, (B) from 0 to 15% by weight of a sodium fatty alcohol sulfate where said fatty alcohol has from 10 to 20 carbon atoms and is selected from the group consisting of alkanols and alkenols, where the sum of the components (A) and (B) is from 35% to 50% by weight, (C) from 5% to 25% by weight of sodium tripolyphosphate, (D) from 5% to 25% by weight of finely crystalline, bound water-containing sodium aluminosilicate having the formula:

$$0.7\text{–}1.5\ Na_2O.Al_2O_3.1.3\text{–}4\ SiO_2$$

and having a calcium binding power of at least 100 mg CaO/gm of active substance (AS) and a particle size of less than 25 $\mu$, with at least 80% by weight of the particles having a size of less than 10 $\mu$, (E) from 5% to 25% by weight of sodium silicate of the composition:

$$Na_2O:SiO_2 = 1:1.5 \text{ to } 1:3.6,$$

(F) from 0 to 10% by weight of sodium sulfate and/or sodium carbonate, and (G) from 8% to 15% of water, including bound water and water of crystallization contained in components (C) to (F), where the sum of the components (C) to (G) is from 50% to 65% by weight.

The preferred detergent compositions are those in which the sum of the components (A) and (B) amounts to 40% to 48% by weight and the sum of the components (C) to (G) amounts to 52% to 60% by weight.

Moveover, the organic components (A) and (B) can optionally contain from 0 to about 5% by weight, being from 0 to about 2% by weight of the individual components, of other customary ingredients of spray-dried washing powders of an organic nature of the type of organic complexing agents, optical brighteners, anti-redepositing (or anti-graying) agents and organic tensides employed as aluminosilicate suspending agents.

Component (A) consists of sodium linear alkylbenzene sulfonate with 10 to 14 carbon atoms in the alkyl chain. The preferred example of this class of compounds is sodium dodecylbenzene sulfonate.

Suitable as component (B) are sodium salts of fatty alcohol sulfates, where the fatty alcohol is derived from saturated and/or monounsaturated primary $C_{12-18}$ fatty alcohols of natural or synthetic origin, preferably alkanols and alkenols having from 12 to 18 carbon atoms. Examples of these are coconut fatty alcohol, tallow fatty alcohol, oleyl alcohol, as well as synthetic alcohols obtainable by ethylene polymerization or oxo-synthesis, the latter consisting of mixtures of linear and $\alpha$-methyl branched alcohols. Especially preferred are coconut fatty alcohol sulfates as well as similarly constituted mixtures of saturated $C_{12}$–$C_{18}$-fatty alcohol sulfates.

The tensides contained in the agents can consist exclusively of alkylbenzene sulfonates, but a tenside mixture is preferred in which the amount of fatty alcohol sulfates (component B) is calculated so that the content of this component (B) in the agent is up to 15% by weight, especially from 3% by weight. In this case, the amount of alkylbenzene sulfonate must be reduced so that the total tenside content does not exceed 50% by weight and the alkylbenzene sulfonate content is especially from 35% to 45% by weight.

The content of sodium tripolyphosphate (component C), calculated with respect to the anhydrous salt, is from 5% to 25% by weight, preferably from 8% to 20% by weight, and especially from 10% to 17% by weight. The tripolyphosphate usually is present as the hexahydrate and its share of water content is added to component (G). The tripolyphosphate usually is in admixture with small amounts of its hydrolysis products, i.e., diphosphate and orthophosphate, that are formed in the aqueous batch or during spray-drying, but their proportion is less than 20% by weight, preferably less than 15% by weight, of the tripolyphosphate employed before spray-drying.

The component (D) consists of finely crystalline sodium aluminosilicates of the formula (I) given above that are capable of cation exchange. The aluminosilicates of formula II:

$$0.7\text{–}1.1\ Na_2O.Al_2O_3.1.3\text{–}3.3\ SiO_2 \qquad (II)$$

are preferred for use. The bound water in the aluminosilicates is also added to the water content of component (G). The aluminosilicates have a particle size of less than 25 $\mu$, and at least 80% by weight of the particles have a size of less than 10 $\mu$. The aluminosilicates have a calcium binding power of at least 100 mg CaO/gm AS, preferably from 120 to 200 mg CaO/gm AS.

The calcium binding power is determined by the following method. One liter of an aqueous solution containing 0.594 gm of $CaCl_2$ (=300 mg CaO/l=30° dH [German hardness]) and adjusted to a pH of 10 with dilute NaOH solution is reacted with 1 gm of aluminosilicate (calculated with respect to AS). Then the suspension is vigorously agitated for 15 minutes at a temperature of 22° C.±2° C. After removing the aluminosilicate by filtering, the residual hardness x of the filtrate is determined. The calcium binding power in mg CaO/gm AS is calculated from this, using the formula: $(30-x)\cdot 10$. This procedure is hereinafter referred to as the Calcium Binding Power Test Method.

The content of the aluminosilicate in the spraydried detergent composition is from 5% to 25%, preferably 8% to 18%, by weight, calculated with respect to anhydrous active substance. Particularly suitable aluminosilicates are synthetic, finely powdered zeolites of the NaA type and NaX type as well as their mixtures.

Suitable as sodium silicates (component E) are compounds of the composition:

$$Na_2O:SiO_2=1:1.5 \text{ to } 1:3.6,$$

and mixtures of variously composed silicates can be used. The ratio is preferably 1:2 to 1:3.5. The sodium silicate content of the agent is from 5% to 20%, preferably 8% to 18%, by weight and specially 12% to 16% by weight. These figures refer to the anhydrous silicate.

The detergent compositions may contain sodium sulfate and/or sodium carbonate as optional component (F) in amounts of up to 15%, preferably not more than 10%, by weight. As far as the component (F) consists of sodium sulfate, its content is generally from 0.2% to 5% by weight. While the components (C) to (E) represent integrating constituents with considerable significance for the granulate characteristics as well as for the cleaning action, component (F) consists of additives and fillers that do not result in any significant product improvement.

The water content, which amounts to a total of from 5% to 12% by weight is a significant constituent of the agent. Part of the water is relatively securely bound, for example, as component constituent of the sodium aluminosilicate. The amount of water removable at a drying temperature of 140° C. is preferably from 4% to 8% by weight. This amount is calculated to prevent oxidative changes and browning during spray-drying and especially dust explosions on the one hand, and to result in the desired granule characteristics, such as strong mechanical resistance, good flow and little tendency to form clumps even under unfavorable conditions as well as sufficiently fast rates of solution, on the other hand. When these values drop clearly below these limits, oxidative changes increase. When they are significantly above, the granule characteristics deteriorate, resulting in impaired mechanical resistance and flow characteristics.

Additional optional components that can be present in small amounts, i.e., up to approximately 2% by weight in the individual case, are organic complexing agents, such as alkali metal salts of the aminoalkane polyphosphonic acids or hydroxyalkane phosphonic acids, for example, aminotrimethylene phosphonic acid, ethylenediamine-tetramethylene phosphonic acid and 1-hydroxyethan-1,1-diphosphonic acids, or of the aminopolycarboxylic acids, such as nitrilotriacetic acid or ethylene diaminetetraacetic acid as well as the higher homologs of the mentioned poly acids. Also suitable as complexing agents are polymeric carboxylic acids that may contain hydroxy, ether and/or carbonyl groups. Further optional components are optical brighteners and components preventing graying or anti-redepositing agents, which include especially the cellulose ethers, such as carboxymethyl cellulose or methyl cellulose. Moreover, small amounts of organic tensides employed as aluminosilicate suspending agents may be present. The sum of all organic components including components (A) and (B) must be calculated so that their proportion does not exceed 50% by weight by any significant amount.

Another subject of the invention is a process for the preparation of the agents, characterized by the fact that the aqueous slurry of the components (A) to (F), which contain 30% to 45% by weight of water, is sprayed in spraydrying equipment with uniflow or countercurrent drying gases at an intake temperature of 150° C. to 350° C. and an outlet temperature of 65° to 95° C. The optional components are also incorporated in the aqueous slurry and spray-dried. The batching of the aqueous slurry is started to advantage with a stabilized suspension of the sodium aluminosilicate, which can be obtained, for example, by the processes according to U.S. Pat. No. 4,072,622 and 4,169,075 and German Published Application DE-OS No. 26 15 698 and DE-OS No. 27 04 310. For a lower water content in the aqueous batch in the interest of reduced energy consumption, dry or low moisture aluminosilicates can be added during subsequent processing. Such stabilized aluminosilicate suspensions usually contain small amounts stabilizers or suspending agents, for example, nonionic tensides or water-soluble polymers, which are incorporated in the final product by this method, but the content of such suspensions in the detergent compositions according to the invention generally lies considerably below 1% by weight, usually below 0.5% by weight, because of the small quantities used in the suspensions.

The remaining components of the detergent compositions can be distributed without problems in the aqueous slurry, and they may be added also as dry substance or, total amount of water permitting, as aqueous paste. The latter frequently applies to the tensides, especially to alkylbenzene sulfonate, which can be incorporated in the aqueous batch as a sodium salt solution, or also as the free acid with the addition of the proper amount of sodium hydroxide as an aqueous solution.

The spraying is usually carried out with nozzles under high pressure. The drying gas consists mainly of air as well as of combustion gases that can be introduced directly into the tower. The drying gas may be directed in parallel flow with the spray product or countercurrent. The countercurrent principle is employed preferably and the drying gas is introduced tangentially into the drying tower to produce a cyclonelike current.

The spray product obtained has a mean granule size of 0.4 to 0.8 mm, and the proportion of particles with a granule size of less than 0.1 mm is less than 10% by weight, especially less than 5% by weight, and a granule size exceeding 1.2 mm is less than 5% by weight, especially not more than 2% by weight. Portions deviating from this granule spectrum are screened out to advantage and can then be returned to the aqueous batch. The bulk density is in the range from 250 to 450 gm/l, preferably from 300 to 400 gm/l.

The spray-dried detergent compositions have a porous granule structure that differs from regular spray-dried, heavy duty detergents or agents for delicate washables in an increased granule compactness that does not impair its solubility properties however. Despite high contents of organic substances, explosive or combustible dusts are not formed during conventional processing. The spray-dried granules have good flow characteristics and do not tend to clump together.

The detergent composition of the invention can be used as detergents without further additions, but additional, commonly used detergent components, such as anionic and/or nonionic synthetic tensides, soap, builder salts, such as phosphates, washing alkalies, such as sodium carbonate, as well as bleaches such as percompounds or active chlorine substances in granular or powder form, or also in another form, can be added subsequently, that is, to the finished product, either immediately before or during its use.

The following examples are illustrative of the invention without being limitative in any manner.

EXAMPLE 1

The components listed below were mixed with a 50% by weight sodium aluminosilicate suspension stabilized with ethoxylated stearly alcohol (5 EO groups). The dodecylbenzene sulfonate was used in the form of 55% aqueous soltuion. The aqueous slurry, which had a 56.3% by weight solids content was heated to 75° C. and then was sprayed with a pressure of 20 bar through nozzles in a spray-drying tower. The countercurrent drying gas consisting of air and combustion gases had an intake temperature of 180° C. and an outlet temperature of 87° C. The recovered spray product had the following composition (% by weight).

| | Percent by Weight |
|---|---|
| Sodium dodecylbenzene sulfonate | 40.0 |
| Sodium sulfate of coconut fatty alcohol | 6.0 |
| Stearyl alcohol plus 5 EO | 0.4 |
| Sodium tripolyphosphate[1] | 15.0 |
| Sodium aluminosilicate[2] | 12.0 |
| Sodium silicate ($Na_2O:SiO_2$ - 1:2.0) | 15.0 |
| Sodium sulfate | 2.0 |
| Water (total) | 9.6 |

-continued

| | Percent by Weight |
|---|---|
| Water, volatile at 140° C. | 6.1 |

[1]The amounts refer to added amounts; the amount of tripolyphosphate remaining after spray-drying was 85% of the original amount.
[2]The sodium aluminosilicate of the NaA type had a particle size of 0.1 to 6μ and a calcium binding powder of 170 mg CaO/gm AS.

The granule size distribution as determined by sieve analysis had the following values (in % by weight):

| | |
|---|---|
| 1.6–0.8 mm | 9.0% |
| 0.8–0.4 mm | 37.7% |
| 0.4–0.2 mm | 37.3% |
| 0.2–0.1 mm | 13.3% |
| 0.1–0.05 mm | 2.7% |
| Below 0.05 mm | — |

The bulk density was 320 gm/liter.

The determination by the Geigy dust test showed a rating number BZ=2 for the combustibility and a dust exexplosion capacity (ignition with an incandescent spiral wire at a concentration of 30 to 500 gm/m$^2$ of ST=0, based on the following rating numbers:

BZ 1: does not burn
BZ 2: brief burning, quick extinction
BZ 3: localized burning or glowing without spreading
BZ 4: spreading of a glowing fire
BZ 5: spreading of an open fire
BZ 6: deflagrationlike burning
St 0: not capable of dust explosion
St 1: weekly capable of dust explosion
St 3: highly capable of dust explosion.

The flow characteristics were tested by the socalled package test. For this purpose, packages of cardboard are uniformly filled to the normal filling level with the product and closed with a lid that is set on top. The contents of the box were compressed with predetermined shakes under defined conditions in a mechanically driven shaking machine, which causes a reproducible compression of the contents. The package was opened and attached to a setup that permits pouring under defined angles of tilt. In addition, the tilted packages can be shaken on motordriven impact equipment. The amount of powder that overflows is collected in a graduated cylinder. The following ratings are given, and the recorded degrees of the angle indicate the position of the package:

| | | | |
|---|---|---|---|
| Grade 1 | 120° C. | | package empties |
| Grade 2 | 120°–140° C. | | package empties |
| Grade 3 | 140°–220° C. | | package empties |
| Grade 4 | 220° C. | 5 impacts | package empties |
| Grade 5 | 220° C. | 10 impacts | package empties |
| Grade 6 | 220° C. | 40 impacts | package doesn't empty |

The consumer registers the Grades 1 to 3 as very good to good, Grade 4 as satisfactory, and Grades 5 and 6 as deficient or unsatisfactory. The determination of the powder immediately after spray-drying resulted in Grade 4, and after three days of storage in Grade 3.

For the agglomeration test, which was also performed, 15 ml of the powder are transferred to a hollow cylinder with an inside diameter of 25 mm and pressed down for 30 minutes with a pestle that is weighted in addition with 500 gm. The cylindrical, pressed material is pushed out with the proper caution, placed in upright position and weight is applied under defined conditions until it breaks apart. The applied load (in grams) is a measure of the agglomeration tendency.

In the present case, the test value for freshly sprayed powder was 30 gm. After three days of storing it was 0 gm. The three-days-of-storage value for commercial detergents is usually 10 to 60 gm.

The dissolving characteristics were determined by the following method.

Two hundred milliliters of tap water (15° dH) warmed to 30° C. were agitated in a beaker at a constant rate of 700 rpm with a motor-driven stirrer equipped with four agitator blades bent downward at an angle of 30°. The distance from the agitator blades to the bottom of the vessel was 2.5 cm. One gram of the sample was cautiously transferred into the formed stirring vortex while avoiding the formation of lumps. After 90 seconds, the solution was poured through a tared screen with a mesh size of 0.1 mm and a diameter of 7 cm and removed with an aspirator. The remains of the substance remaining in the beaker were transferred to the screen with a stream of water that was kept to a minimum. The screen was reweighed after drying in the air for 24 hours.

The amount of residue was 1.6% in the present example.

The recorded values for the pouring characteristics, the agglomeration test and the dissolving behavior are means of 10 tests. The results show that the agents according to the invention possess favorable granule properties. Laundering tests at 30° and 50° C. with cotton and synthetic fabrics in the tub, which were performed with the use of:

(a) 5 gm/l of the agent, (b) 5 gm/l of the agent plus 1 gm/l of sodium perborate, (c) 5 gm/l plus 10 ml of a 10% chlorine bleach solution, produced a prefect laundering result comparable to conventional heavy duty detergents.

EXAMPLES 2 TO 5

As described above, agents of the following composition were produced (in the form of the Na salts) as shown in the following Table I:

TABLE I

| Components in % by Weight | Example 2 | 3 | 4 | 5 |
|---|---|---|---|---|
| Dodecylbenzene sulfonate | 35.0 | 40.0 | 38.0 | 40.0 |
| $C_{12-18}$-fatty alcohol sulfate | 8.0 | 5.0 | 7.0 | 6.0 |
| Stearyl alcohol + 5 EO | 0.4 | 0.3 | 0.3 | 0.3 |
| Tripolyphosphate | 15.0 | 15.0 | 14.0 | 15.0 |
| Aluminosilicate | 15.0 | 12.2 | 11.3 | 12.5 |
| $Na_2O:SiO_2$ = 1:2 | — | — | 16.0 | — |
| $Na_2O:SiO_2$ = 1:3.3 | 15.0 | 15.0 | — | 15.0 |
| Na-sulfate | 1.2 | 2.0 | 2.6 | 1.2 |
| Water | 10.4 | 10.5 | 10.8 | 10.0 |
| Water volatile at 140° C. | 6.4 | 6.1 | 5.9 | 6.1 |

The parameters of the process and the product characteristics are summarized in Table II.

TABLE II

| | Example 2 | 3 | 4 | 5 |
|---|---|---|---|---|
| Slurry concentration in % by weight | 58.5 | 60.5 | 62.0 | 64.0 |
| Dry Air in °C. | | | | |
| Intake | 151 | 162 | 227 | 240 |

TABLE II-continued

| | Example 2 | 3 | 4 | 5 |
|---|---|---|---|---|
| Outlet | 82 | 84 | 84 | 84 |
| Granule size in % | | | | |
| 1.6–0.8 mm | 9.0 | 8.5 | 7.0 | 16.5 |
| 0.8–0.4 mm | 30.0 | 30.5 | 29.0 | 37.0 |
| 0.4–0.2 mm | 40.7 | 40.0 | 42.0 | 32.5 |
| 0.2–0.1 mm | 20.3 | 20.0 | 22.0 | 14.0 |
| 0.1–0.05 mm | — | 1.0 | — | — |
| Apparent Density in gm/l | 368 | 348 | 340 | 310 |
| Dust test | | | | |
| BZ | 2 | 2 | 2 | 2 |
| St | 0 | 0 | 0 | 0 |
| Package test | | | | |
| Fresh | 4 | 3 | 4 | 4 |
| Stored | 3 | 2 | 3 | 3 |
| Agglomeration test | | | | |
| Fresh | 130 | 40 | 30 | 120 |
| Stored | 30 | 10 | 0 | 20 |
| Dissolving characteristics | | | | |
| % Residue | 2.0 | 1.7 | 1.5 | 2.0 |

The above composition of Examples 2 to 5 gave the same excellent wash results as was obtained by the washing composition of Example 1.

The preceding specific embodiments are illustrative of the practice of the invention. It is to be understood, however, that other expedients known to those skilled in the art or disclosed herein may be employed without departing from the spirit of the invention or the scope of the appended claims.

We claim:

1. A high sudsing, granular, spray-dried detergent composition with excellent granule stability comprised of anionic surface-active compounds, sodium tripolyphosphate, sodium aluminosilicate and sodium silicate, having a bulk density of from 300 to 400 gm per liter and a mean granule size of 0.4 to 0.8 mm where the amount of granules with a granule size of less than 0.1 mm is less than 10% by weight and the amount of granules with a granule size of more than 1.2 mm is less than 5% by weight, and having the composition of:

(A) from 35% to 45% by weight of a sodium linear alkylbenzene sulfonate having from 10 to 14 carbons atoms in the alkyl, (B) from 3% to 10% by weight of sodium fatty alcohol sulfate where said fatty alcohol has from 10 to 20 carbon atoms and is selected from the group consisting of alkanols and alkenols, where the sum of the of the components (A) and (B) is from 40% to 48% by weight, (C) from 8% to 20% by weight of sodium tripolyphosphate, (D) from 8% to 18% by weight of finely crystalline, bound water-containing sodium aluminosilicate having the formula:

$$0.7\text{–}1.5\ Na_2O.Al_2O_3.1.3\text{–}4\ SiO_2$$

and having a calcium binding power of at least 100 mg CaO/gm of active substance (AS) and a particle size of less than 25μ, with at least 80% by weight of the particles having a size of less than 10μ, (E) from 8% to 18% by weight of sodium silicate of the composition:

$$Na_2O:SiO_2 = 1:2 \text{ to } 1:3.5,$$

(F) from 0 to 10% by weight of sodium sulfate and/or sodium carbonate, and (G) from 8% to 15% by weight of water, including bound water and water of crystallization contained in components (C) to (F), the amount of water removable at a drying temperature of 140° C. being from 4% to 8% by weight, where the sum of the components (C) to (G) is from 52% to 60% by weight, produced by spray-drying an aqueous slurry of the constituents at drying gas outlet temperature of up to 95° C.

2. The detergent composition of claim 1 further containing from 0 to 5% by weight, being from 0 to about 2% by weight of the individual components, of other customary ingredients of spray-dried washing powders of an organic nature selected from the group consisting of organic complexing agents, optical brighteners, anti-redepositing agents and organic tensides employed as aluminosilicate suspending agents.

3. The detergent composition of claim 1 wherein component (F) is sodium sulfate and is present in an amount of from 0.2% to 5% by weight.

4. A process for the production of the detergent composition of claim 1 comprising spray-drying a mixture of the the components (A) to (F) in an aqueous slurry containing from 30% to 45% by weight of water through a nozzle into a spray-drying area having a drying gases intake temperature of 150° C. to 350° C. and an outlet temperature of 65° C. to 95° C., and recovering said detergent composition.

* * * * *